US005566933A

United States Patent [19]

Salancy

[11] Patent Number: 5,566,933

[45] Date of Patent: Oct. 22, 1996

[54] RAIL SUPPORT FOR DOCUMENT QUEUING STATION

[76] Inventor: William A. Salancy, 20 Tod Rd., Norwalk, Conn. 06851

[21] Appl. No.: 380,169

[22] Filed: Jan. 30, 1995

[51] Int. Cl.[6] ..... B65H 5/04

[52] U.S. Cl. ..... 271/273; 271/188; 271/245; 271/246

[58] Field of Search ..... 271/273, 220, 271/188, 209, 245, 246

[56] References Cited

U.S. PATENT DOCUMENTS

| | | | |
|---|---|---|---|
| 3,944,211 | 3/1976 | Rasmussen et al. | 271/245 |
| 3,952,651 | 4/1976 | Bolza-Schünemann | 271/246 |
| 4,618,302 | 10/1986 | Kokubo et al. | 271/273 |
| 4,725,053 | 2/1988 | Bastow et al. | 271/246 |
| 4,750,853 | 6/1988 | Van Soest et al. | 271/220 |
| 5,094,443 | 3/1992 | Young, Jr. | 271/245 |
| 5,244,200 | 9/1993 | Manzke | 271/220 |
| 5,253,861 | 10/1993 | Schmaling | 271/273 |

FOREIGN PATENT DOCUMENTS

| | | | |
|---|---|---|---|
| 61-55036 | 3/1986 | Japan | 271/209 |

*Primary Examiner*—Karen Merritt
*Assistant Examiner*—Douglas Hess
*Attorney, Agent, or Firm*—Lawrence E. Sklar; Melvin J. Scolnick

[57] ABSTRACT

Document registration apparatus, including: a deck for supporting documents along a document path from an upstream position to a downstream position; a pair of transport belts for transporting the documents along the document path; a plurality of laterally spaced registration stops defining a document registration position in the document path, the stops being located at a downstream position substantially perpendicular to the document path for both stopping the documents at the document registration position and for aligning the documents relative to the document path; a pinch roller situated above each of the pair of transport belts at an upstream position for urging the stopped documents against the transport belts; and a pair of laterally spaced belt/paper supports secured to the deck. Each of the belt/paper supports has a belt supporting surface for supporting the transport belt and a pair of paper supporting rails for supporting the documents above the transport belt when the documents are against the registration stops.

6 Claims, 5 Drawing Sheets

RAIL SUPPORT FOR DOCUMENT QUEUING STATION

BACKGROUND OF THE INVENTION

The instant invention relates to a sheet accumulator with continuously moving belts, and more particularly to a rail support mechanism for supporting the belts and paper sheets at a document queuing station.

Various document processing systems, such as in an inserting machine require that a document is aligned relative to a particular station in the system prior to being processed at the station. Typically, this is accomplished by registering a particular edge of the document in a particular direction in the system. For example, documents must be aligned before being conveyed to a folding apparatus in order to achieve a proper fold. Also, enclosures which are to be inserted into an envelope should be aligned relative to the envelope prior to insertion in order to avoid processing difficulties. Furthermore, some documents which are to be transported away from a particular queuing station, to another adjacent document raceway, should be aligned at the queuing station relative to the raceway, in order to facilitate the processing of the documents.

Devices which register a particular edge of a document to a particular direction are known. See, for example U.S. Pat. Nos. 3,637,203, 4,078,790 and 4,925,180, which utilize stops that pivot into position to stop the advancement of documents being conveyed in a particular direction. Some registration devices, such as stationary side guides, perform the task of aligning the document while the document is being conveyed. Other devices, such as a "queuing" station, perform the dual task of aligning the document and stopping the document until tile next successive station is ready to receive the document for further processing. Typically, queuing stations comprise mechanisms which register the document by stopping, i.e., queuing the document. Queuing stations are typically configured to handle documents of a particular length and are not easily reconfigured to handle sheets of a different length.

Generally, during the stacking and registration of documents at a queuing station there is always the potential for the documents to become shingled, i.e., the top document in the stack is not directly above the lower documents but slightly shifted forward or backward, as they are conveyed from the queuing station.

Currently available commercial queuing stations include pinch rollers cooperating with transport belts to remove documents from the queuing station. The pinch rollers pivot into engagement with the stack of documents as the registration stops pivot out of the way. Although this arrangement has been found to reduce the shingling of the stack of documents, it has not eliminated such shingling.

In an attempt to eliminate such shingling, there is disclosed in U.S. Pat. No. 5,253,861 issued Oct. 19, 1993 to the assignee of the instant invention an improvement to a document registration apparatus that includes a plurality of laterally-spaced registration stops which pivot about a horizontal axis for stopping the motion of documents and registering the leading edge of the documents to a particular direction in the apparatus. The apparatus also includes at least one pinch roller cooperating with conveying structure for moving the registered documents away from the apparatus for further processing. The improvement includes structure for supporting the documents above the conveying structure when the documents are situated against the registration stops. The conveying structure includes a pair of transport belts and the supporting structure includes at least a pair of deck rails laterally positioned between the transport belts. A pair of pinch rollers urge the documents against the transport belts when the registration stops move away from the document path.

The aforementioned '861 improvement has been found to reduce shingling at the queuing station, but has not eliminated shingling. Shortcomings in the '861 improvement were noticed with thin paper, which sagged between the laterally positioned deck rails and contacted the transport belts. Thus, the lowermost sheet of thin documents was moved away from the queuing station before the pinch rollers urged the stack of documents against the transport belts. Thus, the stack of documents was not moved away from the queuing station in total registration but rather the stack had suffered the effects of shingling.

Accordingly, the instant invention provides a support for the paper and transport belts at the queuing station that is able to lift the registered sheets of paper of any thickness away from the moving belt surfaces to thereby eliminate any shingling effects in the registered sheets as they are moved away from the queuing station.

SUMMARY OF THE INVENTION

The instant invention provides document registration apparatus, comprising: a deck for supporting documents along a document path from an upstream position to a downstream position; a pair of transport belts for transporting the documents along the document path; a plurality of laterally spaced registration stops defining a document registration position in the document path, the stops being located at a downstream position substantially perpendicular to the document path for both stopping the documents at the document registration position and for aligning the documents relative to the document path; a pinch roller situated above each of the pair of transport belts at an upstream position for urging the stopped documents against the transport belts; and a pair of laterally spaced belt/paper supports secured to the deck. Each of the belt/paper supports has a belt supporting surface for supporting the transport belt and a pair of paper supporting rails for supporting the documents above the transport belt when the documents are against the registration stops.

DETAILED DESCRIPTION OF THE PREFERRED EMBODIMENT

Figure 1:
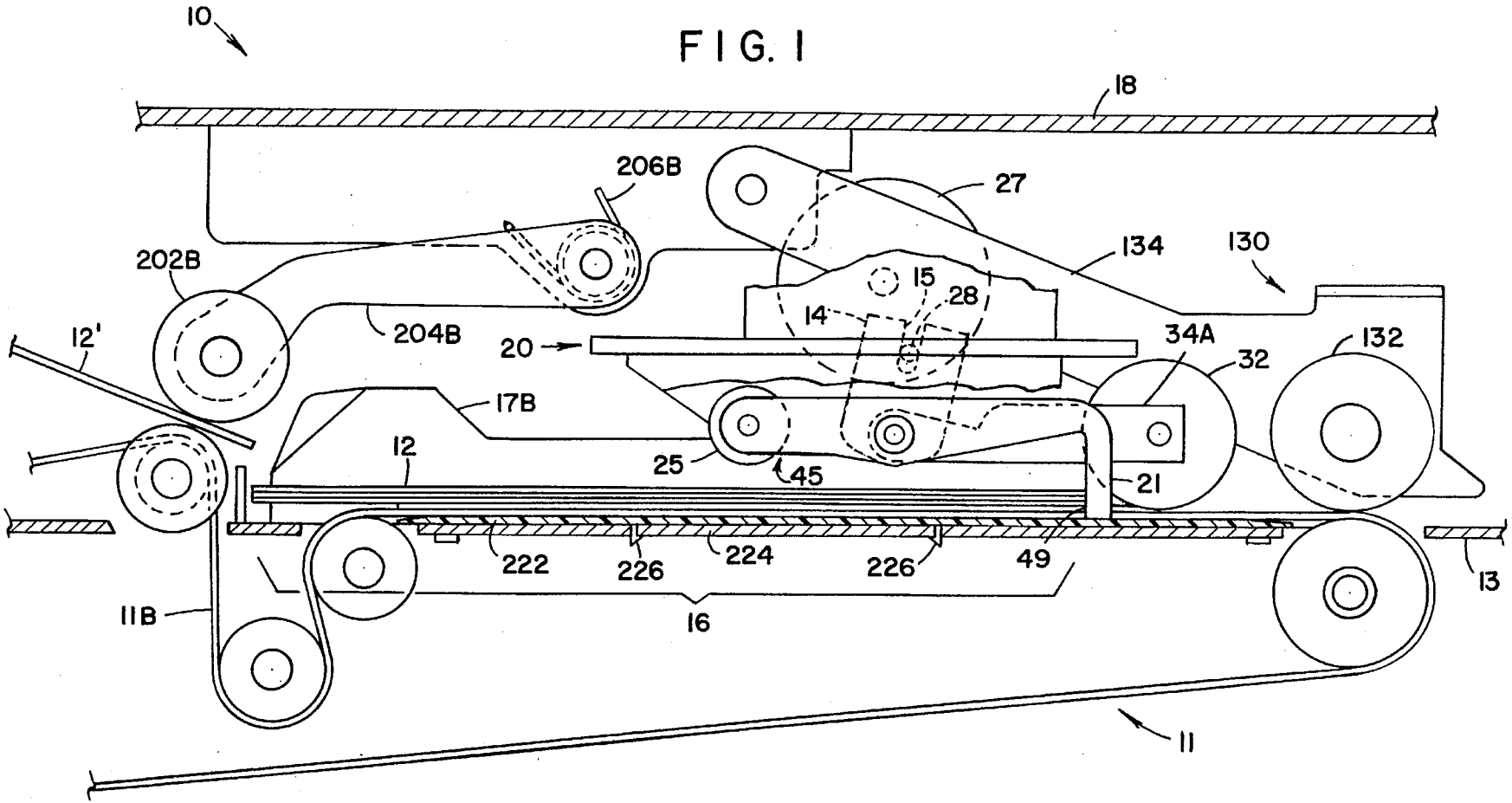
FIG. 1 is a side, elevational view of document registration apparatus in accordance with the instant invention and shows the registration stops lowered to stop and register documents.

In describing the preferred embodiment of the instant invention, reference is made to the drawings, wherein there is seen a document registration apparatus, generally shown as 10, used in conjunction with a document transport system, generally designated 11. Registration apparatus 10 cooperates with transport system 11 in transporting a document 12' along a path defined by a deck 13 in an upstream to downstream direction, shown left to right in FIGS. 1 and 2. There is a document registration position 16 on a deck plate 224 where each document 12' is stopped in its path by registration unit 10 and is held or "queued" until the next successive station in the processing system is ready to process a stack of documents 12. Document registration apparatus 10 simultaneously stops and aligns each document 12' relative to deck 13.

Each document 12' is separately transported, for example, from a sheet feeder (not shown), by the transport system 11. In the preferred embodiment of the present invention, transport system 11 includes two transport belts 11A and 11B which move in synchronization. Registration apparatus 10 includes a top plate 18 and a pair of pinch rollers 202A and 202B that are respectively mounted to one end of arms 204A and 204B. (Roller 202A and arm 204A are not shown but are designated to show cooperative relationship to belt 11B). Arms 204A and 204B are mounted at their other ends to top plate 18 of registration apparatus 10 and are biased toward belts 11A and 11B respectively by springs 206A (not shown) and 206B. Thus, pinch rollers 202A and 202B apply a normal force to document 12' as it is transported by belts 11A and 11B to registration position 16. Side guides 17A and 17B maintain side alignment of document 12' as it is transported to registration position 16.

Document registration apparatus 10 is suitable for use in a queuing station, for example after a sheet feeder or an enclosure feeder, or in an inserting station of an inserting machine wherein documents 12 must be stopped, accumulated and aligned before further processing. The registration apparatus 10 is suitably mounted to the frame (not shown) of the inserting machine. For example, apparatus 10 can be pivotably mounted at the upstream end to provide easy access for document jams.

Figure 2:
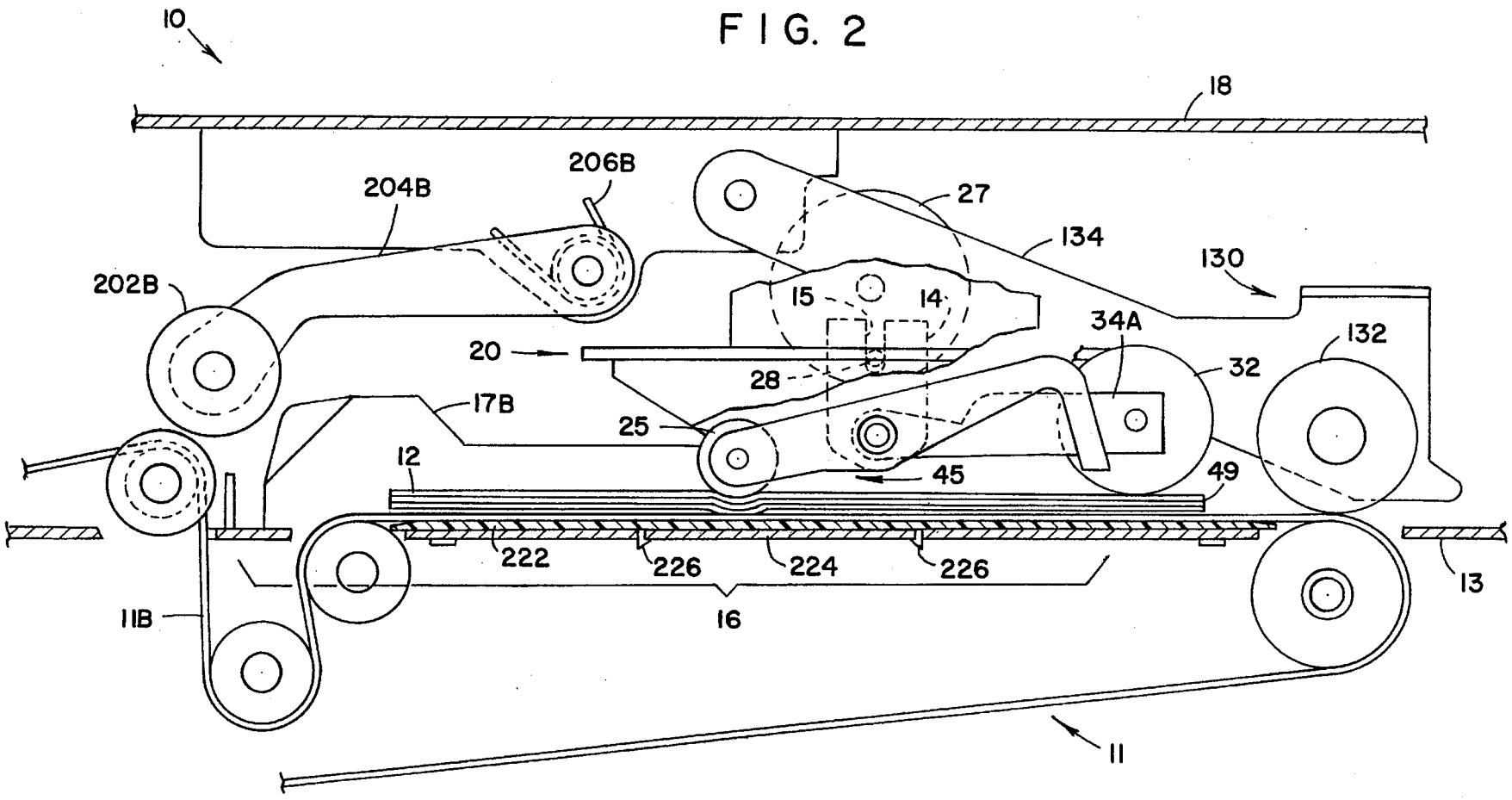
FIG. 2 is similar to FIG. 1 but shows the registration stops raised and the registered stack of documents being moved downstream away from the queuing position.
Figure 8:
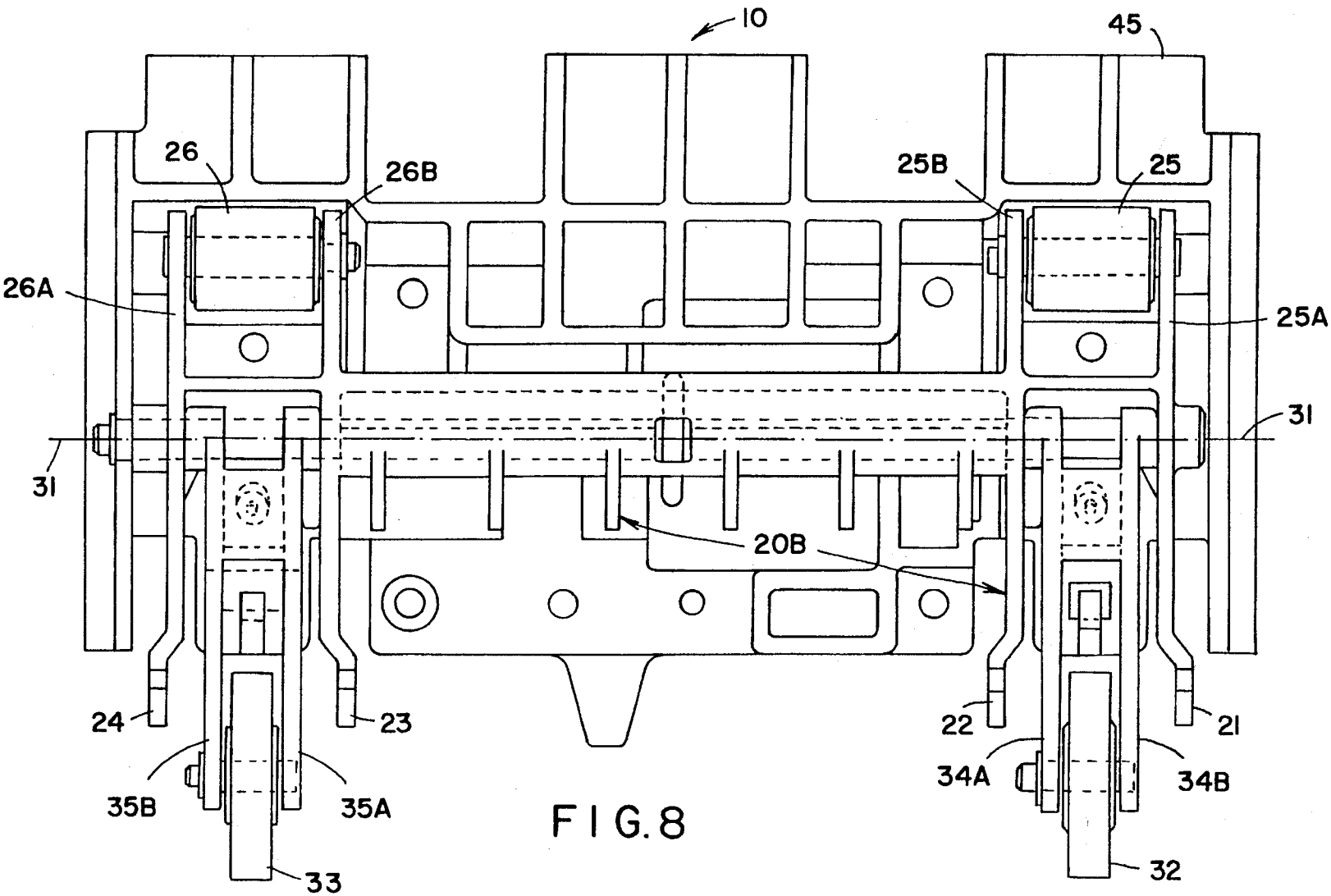
FIG. 8 is a bottom, plan view of a registration unit of the document registration apparatus seen in FIG. 1.

The document registration apparatus 10 comprises a document registration unit 20 pivotably mounted to the top plate 18. As shown in FIGS. 1, 2 and 8, document registration unit 20 is preferably formed from a one piece document registration unit holder 45, to which a one piece frame member 20B is attached. Frame member 20B includes four registration stops 21, 22, 23 and 24 on the downstream end thereof and two pinch rollers 25 and 26 on pinch roller arms 25A–B and 26A–B, respectively, on the upstream end of unit 20. Pinch rollers 25 and 26 are spaced at lateral positions between the lateral positions of registration stops 21 and 22 on the one hand, and the lateral positions of registration stops 23 and 24 on the other hand, respectively. Frame member 20B pivots vertically around pivot axis 31. A rotary solenoid 27 is linked to a pivoting arm 14 by a pin 28 which rides in a slot 15 of the arm 14. Pin 28 moves along a circular path on each actuation of solenoid 27 and reciprocates in slot 15, thereby rocking pivot arm 14. As pivot arm 14 rocks, frame member 20B of document registration unit 20 pivots vertically around pivot axis 31.

The combination of registration stops 21–24 and pinch rollers 25 and 26 is used to stop and align documents 12 at document registration position 16, and then to release them for further processing. Documents 12 are aligned at this position so that they can subsequently be processed with minimal skew relative to deck 13. For example, if documents 12 are collected to form a stack of documents which will subsequently be folded, then registration stops 21–24 ensure that the documents are aligned so that the folder can make a square fold of the documents.

Figure 3:
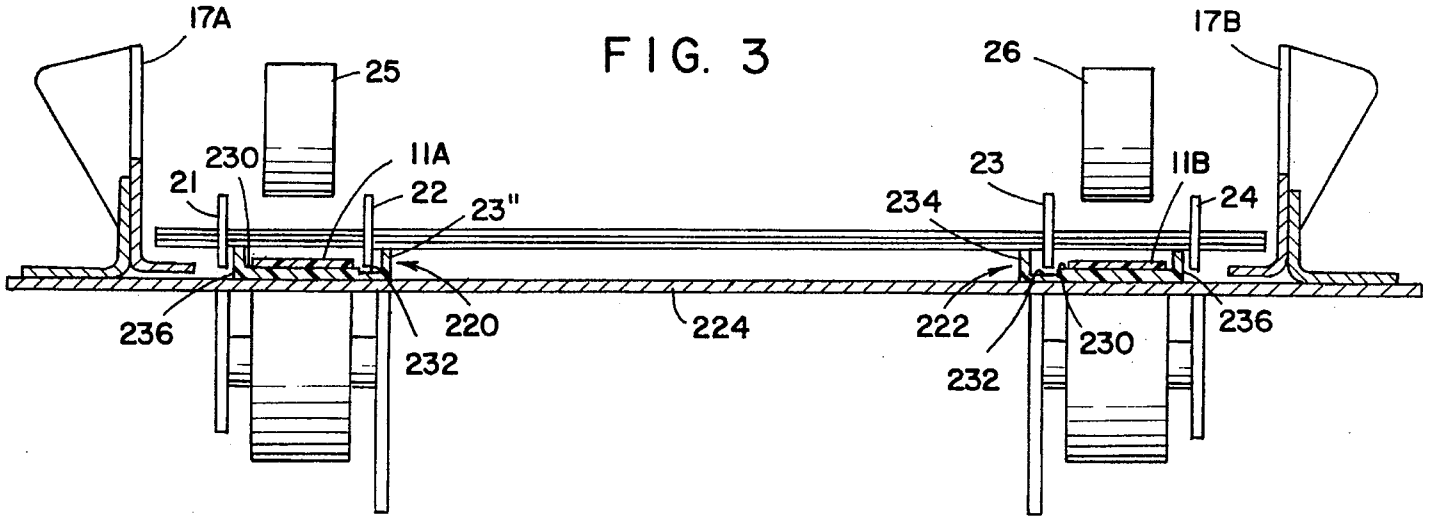
FIG. 3 is a partial, front view of the apparatus seen in FIG. 1.

In order to stop documents 12 at document registration position 16, registration stops 21–24 are urged clockwise to a registration position, shown in FIGS. 1 and 3, by actuating the solenoid 27. In this position, registration stops 21–24 extend downward so as to block documents 12 from being transported further downstream. Preferably, transport belts 11A and 11B are each approximately 0.5 inch wide. Laterally spaced on each side of each transport belt 11A and 11B are the registration stops 21, 22 and 23, 24 respectively. Registration stops 21–24 are laterally spaced along document registration unit 20 so that when documents 12 are stopped at document registration position 16, the downstream edges 49 of documents 12 are aligned with respect to deck 13.

Heretofore, as disclosed in U.S. Pat. No. 5,253,861, the documents 12 were accumulated on a transport deck at registration position 16 and belts 11A and 11B were flush with the transport deck. Since the bottom document of the documents 12 accumulated at the registration position 16 was in contact with the continuously moving transport belts 11A and 11B, belts 11A and 11B were continuously urging document 12 against stops 21–24. Stops 21–24 were projected below the plane of transport belts 11A and 11B to assure that documents 12 could not slip through. Thus, when in the lowered or registration position, registration stops 21–24 prevented the advancement or shingling of documents 12. However, when registration stops 21–24 were raised to release documents 12, a certain amount of shingling of documents 12 was caused by continuous moving belts 11A and 11B until pinch rollers 25 and 26 provided adequate force against documents 12 so that belts 11A and 11B could transport documents 12 as a stack.

Figure 4:
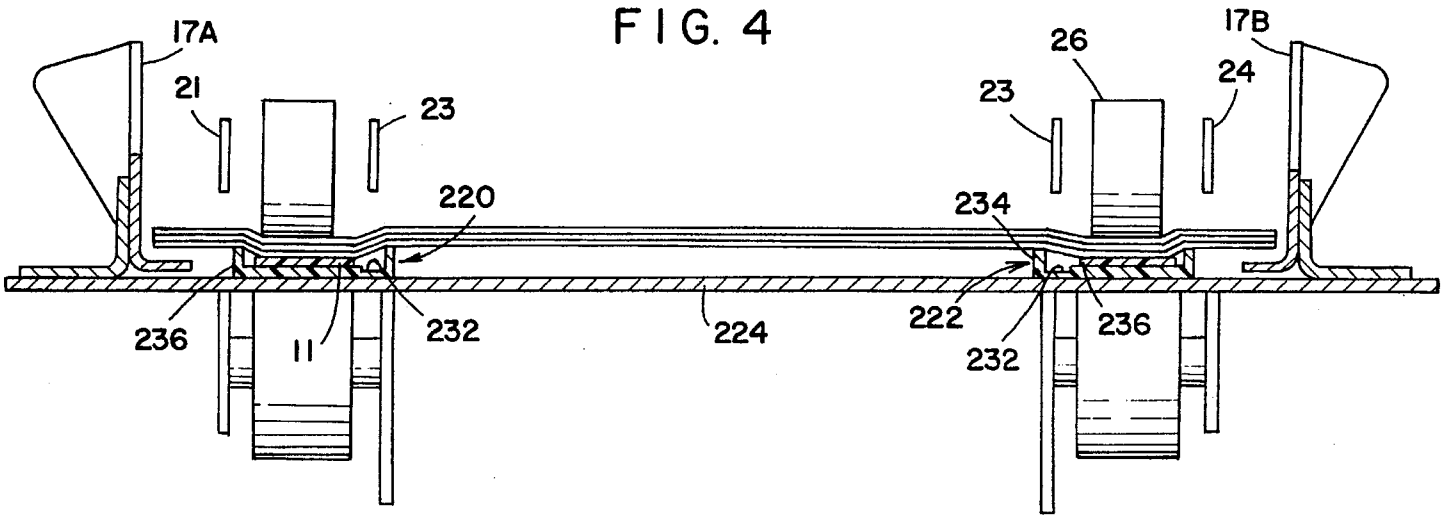
FIG. 4 is a partial, front view of the apparatus seen in FIG. 2.
Figure 5:
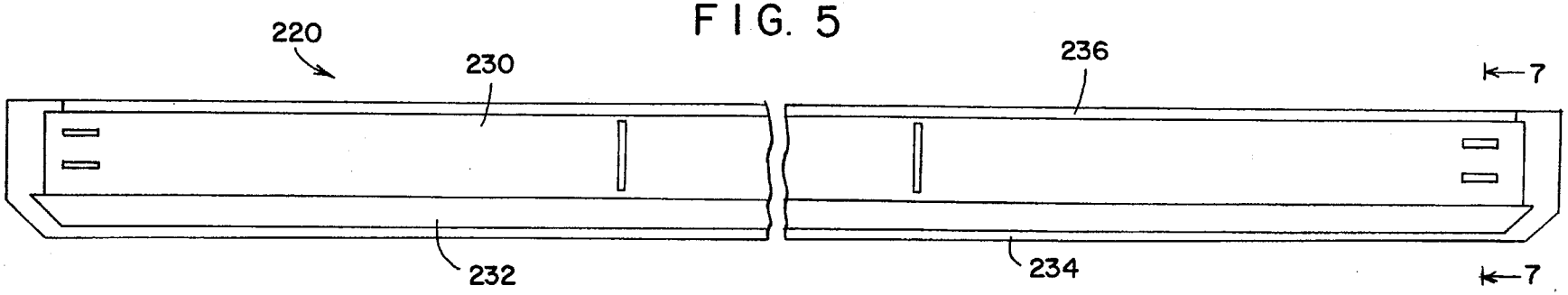
FIG. 5 is a top, plan view of the belt and paper rail support seen on the right side in FIGS. 3 and 4.
Figure 6:
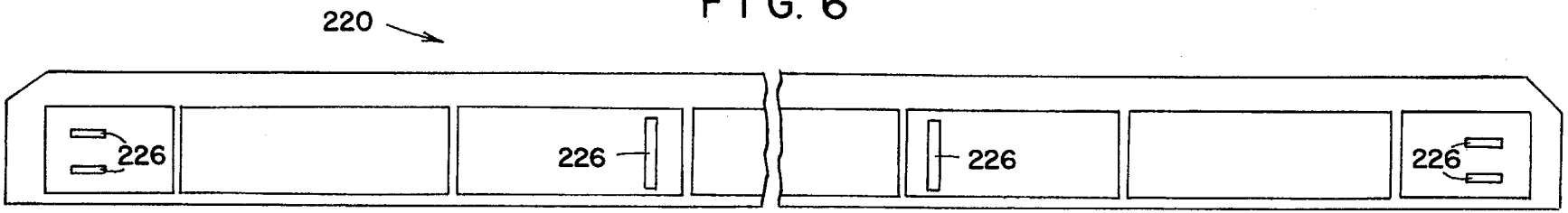
FIG. 6 is similar to FIG. 5 but shows the rail support on the left side in FIGS. 3 and 4.
Figure 7:
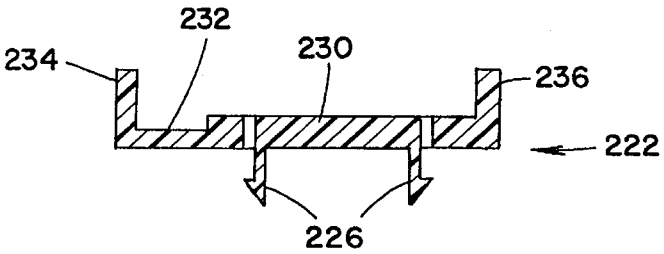
FIG. 7 is a sectional view taken on the plane indicated by the line 7—7 in FIG. 5.

In accordance with the instant invention, the documents 12 are accumulated at registration position 16 on a deck plane that is above the belts 11A and 11B. As seen in FIGS. 1–4, a pair of belt/paper supports 220 and 222 are secured to the deck plate 224 by means of a plurality of snaps 226. The supports 220 and 222 are located beneath the belts 11A and 11B respectively and are mirror images of each other. Accordingly, a detailed description will now be provided for the support 222 seen in FIG. 7, it being understood that the same description applies to the support 220. The support 222 includes belt supporting surface 230, an adjacent groove 232 and an interior paper supporting rail 234 and an exterior paper supporting rail 236. The top of the rails 234 and 236 have a height "d" over the top of the belts 11A and 11B. The supports 220 and 222 are spaced laterally such that documents 12 remain above and do not touch the belts 11A and 11B while the documents 12 are being accumulated at the position 16, in this manner, the continuous travel of the transport belts 11A and 11B do not affect the documents 12 at the registration position 16 until the pinch rollers 25 and 26 are caused to urge the documents 12 against the belts 11A and 11B. When it is time to release the documents 12, solenoid 27 is actuated to pivot the registration stops 21–24 to a raised position and the pinch rollers 25 and 26 to a lowered position, as seen in FIGS. 2 and 4. The pinch rollers 25 and 26 urge the documents 12 against the transport belts 11A and 11B, thus providing frictional force between documents 12 and transport belts 11A and 11B. The frictional force moves documents 12 downstream for further processing.

The distance "d" between the top of the rails 234 and 236 and the top of the belts 11A and 11B is preferably about 0.025", with a range of 0.023" to 0.027" being acceptable. As seen in FIG. 3, the interior registration stops 22 23 are seated in the grooves 232 when in their lowered positions. However, depending upon design and space considerations, the groove 232 can be eliminated from the supports 220 and 222 and all of the stops 21–24 can be situated outside the supports 220 and 222.

As documents 12 move in the downstream direction, they encounter exit pinch rollers 32 and 33 which are mounted on independent sets of support arms 34A, 34B and 35A, 35B, corresponding to exit pinch rollers 32 and 33, respectively, and which also pivot about pivoting axis 31. Arms 34A, 34B and 35A, 35B and thus rollers 32 and 33, are respectively spring biased by separate torsion springs (not shown) to pinch rollers 32 and 33 against transport belts 11A and 11B. Rollers 32 and 33 move away from belts 11A and 11B when documents 12 are released, but move back into engagement with transport belts 11A and 11B as soon as documents 12 are conveyed beyond rollers 32 and 33. The released stack of documents 12 is thus urged against transport belts 11A and 11B and transported for further processing. The mounting of pinch rollers 32 and 33 on separate support arms 34, 34B and 35A, 35B helps prevent any shingling of documents 12 when they exit registration position 16. This is because rollers 32 and 33 and sets of arms 34A, 34B and 35A, 35B can move away from transport belts 11A and B as required by the thickness of the stack of documents 12 to allow the stack to pass, without lifting the remainder of registration unit 20.

Downstream from rollers 32 and 33 is a pinch roller assembly 130 which comprises a pair of pinch rollers 132 (only one is shown in FIGS. 1 and 2) which are rotatably mounted to support arm 134. Pinch roller assembly 130 provides the last normal force that is applied by document registration apparatus 10 to documents 12 as they are conveyed away from its control.

From the foregoing description, it can be see that the bottom sheet in a stack of documents 12 is prevented from advancing prematurely beyond the registration position 16, thereby eliminating any shingling effects in the registered documents.

While the present invention has been disclosed and described with reference to a single embodiment thereof, it will be apparent, as noted above that variations and modifications may be made therein. It is thus intended in the following claims to cover each variation and modification that falls within the true spirit and scope of the present invention.

What is claimed is:

1. Document registration apparatus, comprising:

a deck for supporting documents along a document path from an upstream position to a downstream position;

a pair of transport belts for transporting said documents along said document path;

a plurality of laterally spaced registration stops defining a document registration position in said document path, said stops located at a downstream position substantially perpendicular to the document path for both stopping said documents at the document registration position and for aligning said documents relative to said document path;

a pinch roller situated above each of said pair of transport belts at an upstream position for urging the stopped documents against said transport belts; and a pair of laterally spaced belt/paper supports secured to said deck, each of said supports having a belt supporting surface for supporting said transport belt and a pair of paper supporting rails for supporting said documents above said transport belt when said documents are against said registration stops.

2. The apparatus of claim 1, additionally comprising a frame member wherein said registration stops extend from the downstream end thereof and the pinch roller extends from the upstream end thereof.

3. The apparatus of claim 1, wherein the top of the paper supporting rails is between about 0.023" and 0.027" above the top of said belts.

4. The apparatus of claim 3, wherein the top of the paper supporting rails is about 0.025" above the top of said belts.

5. The apparatus of claim 3, wherein said belt/paper supports include a groove between said belt supporting surface and one of said paper supporting rails.

6. The apparatus of claim 5, wherein at least one of said registration stops engages one of said grooves.

* * * * *

UNITED STATES PATENT AND TRADEMARK OFFICE

CERTIFICATE OF CORRECTION

PATENT NO. : 5,566,933

DATED : October 22, 1996

INVENTOR(S) : William A. Salancy

It is certified that error appears in the above-identified patent and that said Letters Patent is hereby corrected as shown below:

Cover Page: Add item [73] Assignee: Pitney Bowes Inc.
Stamford, Connecticut

Signed and Sealed this

Seventeenth Day of March, 1998

*Attest:*

*Attesting Officer*

BRUCE LEHMAN

*Commissioner of Patents and Trademarks*